United States Patent [19]

Wood

[11] 4,138,753

[45] Feb. 13, 1979

[54] AQUATIC MAT

[75] Inventor: Robert L. Wood, Wichita Falls, Tex.

[73] Assignee: Advanced Sports Corporation, Wichita Falls, Tex.

[21] Appl. No.: 743,340

[22] Filed: Nov. 19, 1976

Related U.S. Application Data

[60] Division of Ser. No. 609,049, Aug. 29, 1975, Pat. No. 4,006,503, which is a continuation-in-part of Ser. No. 594,018, Jul. 8, 1975, abandoned.

[51] Int. Cl.[2] ..... A47C 27/08

[52] U.S. Cl. ..... 9/13; 5/353; 9/310 E

[58] Field of Search ..... 9/11 R, 11 A, 13, 14, 9/310 E, 310 F, 310 D, 301, 310 J, 310 R, 311; 5/348, 353; 272/1 B; D34/41, 42

[56] References Cited

U.S. PATENT DOCUMENTS

| | | | |
|---|---|---|---|
| D. 157,564 | 3/1950 | Byerly | D34/42 |
| 1,723,473 | 8/1929 | Erickson | 9/310 E |
| 3,378,864 | 4/1968 | Cornes | 9/11 A |

FOREIGN PATENT DOCUMENTS

| | | | |
|---|---|---|---|
| 1145971 | 3/1969 | United Kingdom | 9/11 R |

*Primary Examiner*—Trygve M. Blix
*Assistant Examiner*—D. W. Keen
*Attorney, Agent, or Firm*—M. Ted Raptes

[57] ABSTRACT

A buoyant, flexible, resilient aquatic mat for use on water surfaces adapted to support one or more persons. The mat comprises an elongated slab and a headrest formed of the same material. The material of the mat comprises a unicellular, non-water absorbent, plastic foam having a tough plastic coating over the entire surface. The headrest comprises a transverse void which provides additional buoyancy. Several embodiments of the aquatic mat are described, and in addition, a modification applicable to all the embodiments, wherein the void of the headrest is enclosed at both ends to provide a closed air chamber and alternatively, the closed air chamber can have vent holes communicating therewith through the bottom of the headrest.

12 Claims, 11 Drawing Figures

AQUATIC MAT

This is a division of application Ser. No. 609,049 filed Aug. 29, 1975, now U.S. Pat. No. 4,006,503, which is a continuation-in-part of application Ser. No. 594,018, filed July 8, 1975, now abandoned.

BACKGROUND OF THE INVENTION

This invention relates to an aquatic floatation mat or cushion providing sufficient buoyancy to permit a person to lie on the mat in water.

Aquatic mats now used for recreation and sports purposes are generally of the inflatable type. Although the inflatable types are satisfactory, they require the task of inflating them prior to use and deflating them after use. Furthermore, inflatable types can easily be punctured, ripped or torn. This will require patching, and if the tear or rip is large enough and cannot be patched, will render the mat useless.

The flotation mat of the present invention constitutes an improvement over inflatable mats by eliminating the requirement for inflation and also eliminating the problem of punctures, rips and tears.

SUMMARY OF THE INVENTION

It is an object of this invention to provide a novel aquatic mat with a headrest having a simplified construction, which is capable of floating on water, and which can support one or more persons.

It is another object of this invention to provide a novel aquatic mat having a headrest wherein the entire mat is manufactured from buoyant flexible, resilient slab materials.

Another object of this invention is to provide a novel buoyant, aquatic mat having a headrest for supporting a person's head containing one or more transverse open voids, which provide additional bouyancy to the headrest.

A further object of this invention is to provide a novel buoyant aquatic mat having a headrest containing an enclosed transverse chamber or chambers.

An additional object of this invention is to provide a novel buoyant aquatic mat having a headrest containing an enclosed chamber or chambers wherein the bottom of the headrest chamber has vent holes for providing equalization of pressure in the chamber and for providing additional buoyancy to the headrest.

Generally the buoyant aquatic mat comprises an elongated, flexible, resilient, planar slab member and a headrest member containing a transverse void formed from the same material as the planar slab member. The slab material comprises a unicellular, non-water absorbent plastic foam having a tough, plastic coating over the entire surface of the slab. Several embodiments of the mat are described. Furthermore, a modification adaptable to all the embodiments of the mat comprises slab material enclosing the ends of the void of the headrest forming an air chamber. An additional modification of the headrest with enclosed chambers is the provision of vent holes disposed through the bottom of the headrest communicating with the air chamber.

Other features and advantages of the various embodiments of the aquatic mat of the invention will become apparent from the following description of specific embodiments thereof taken in conjunction with the drawings.

DETAILED DESCRIPTION OF THE INVENTION

Figure 1:
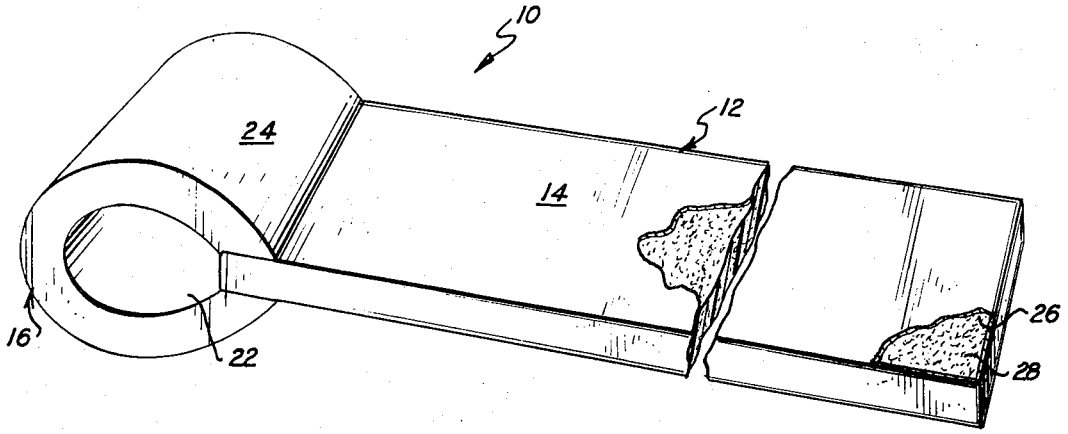
FIG. 1 is a perspective view of one embodiment of the aquatic mat of this invention.
Figure 2:
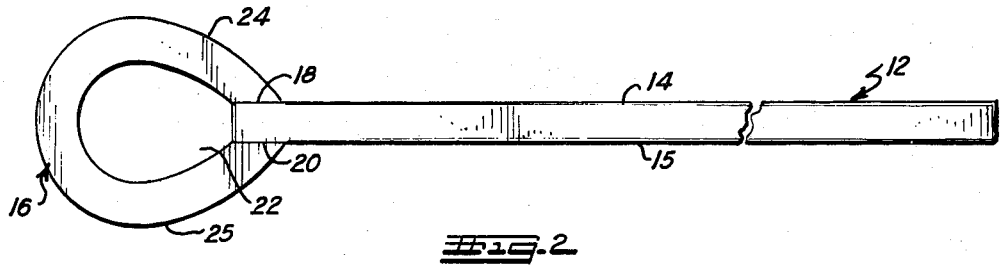
FIG. 2 is a side elevational view of the aquatic mat shown in FIG. 1.
Figure 3:
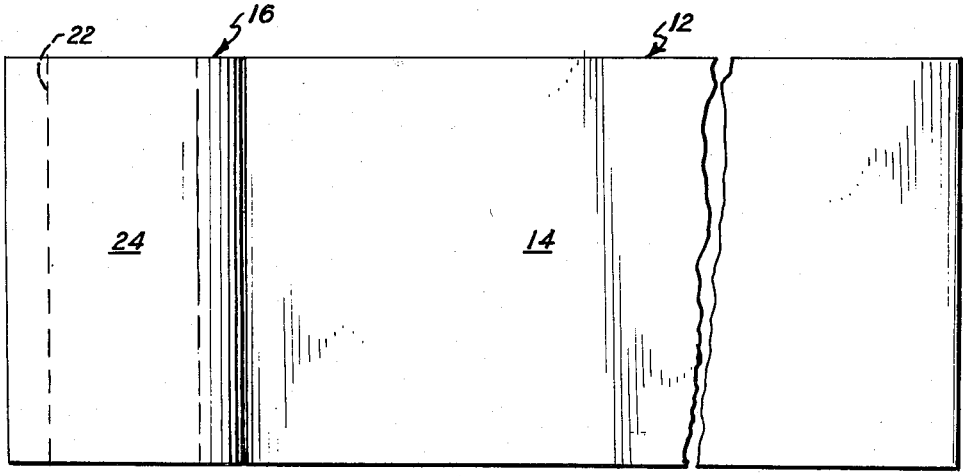
FIG. 3 is a top plan view of the aquatic mat shown in FIG. 1.

Referring to FIGS. 1—3 of the drawings, the numeral 10 in FIG. 1 generally denotes a first embodiment of the aquatic mat of the invention. The mat 10 comprises an elongated slab generally denoted by the numeral 12, having planar surfaces 14 and 15, a generally rectangular shape, and a suitable thickness of one to three inches or more. Although a rectangular shape is shown, it is contemplated within the scope of the invention that other geometric shapes can be used such as circular, ovate, polygonal, etc. The slab is of a sufficient surface area, i.e., length and width, to accommodate a person or persons lying prostrate on one of its surfaces 14 or 15.

The slab is constructed or molded from a suitable, flexible, resilient material 28, which is non-water absorbent, such as plastic foam or the like. Particularly, the plastic foam is a unicellular, flexible, plastic foam, i.e., a foam having closed cells, such as plastic foams produced from polyvinylchloride, and the like. The plastic foam materials is relatively firm, but at the same time has, buoyancy in water, resiliency and flexibility for supporting a person. A surface coating or casing 26, preferably smooth, covers the entire resilient material throughout all its surfaces and is a tough, pliable, tear resistant material of a suitable plastic material, or the like. The coating is preferably applied on the surfaces of the resilient material by spraying, dipping or by any other suitable means, whereby the coating adheres tenaceously to the surfaces. Plastic materials are preferred for the coating, since there are available on the market many tough, rugged, pliable plastic coating materials such as polyvinylchloride, etc. Hereinafter, all the materials used in the construction of the aquatic mats are of the type described above.

Mat 10 also comprises a headrest member generally denoted by the numeral 16 which is of the same slab material as slab 12. Headrest 16 is a plastic coated slab, the ends of which are bonded to one end of coated slab 12 at 18 and 20. In the preferred construction of the mat, plastic coated foam slabs 12 and 16 are bonded together as shown. The slab 16 is bonded first at 18 then curved around the end of slab 12, and bonded at 20. Alternatively, the mat can be constructed from non-plastic coated slabs by bonding the ends of slab 16 similarly to the end of slab 12. The entire constructed mat can then be dipped in or coated with the plastic coating.

The headrest 16 of mat 10 comprises headrest surfaces 24 and 25 upon which a person's head can rest. Thus, the embodiment 10 can be used on either side 14 or 15. A transverse void 22 in the headrest is open at both ends and provides a certain amount of bouyancy to the headrest area. The entire mat is adapted to float on a surface of water and is designed to support the weight of one or more persons, depending on its size.

Figure 4:
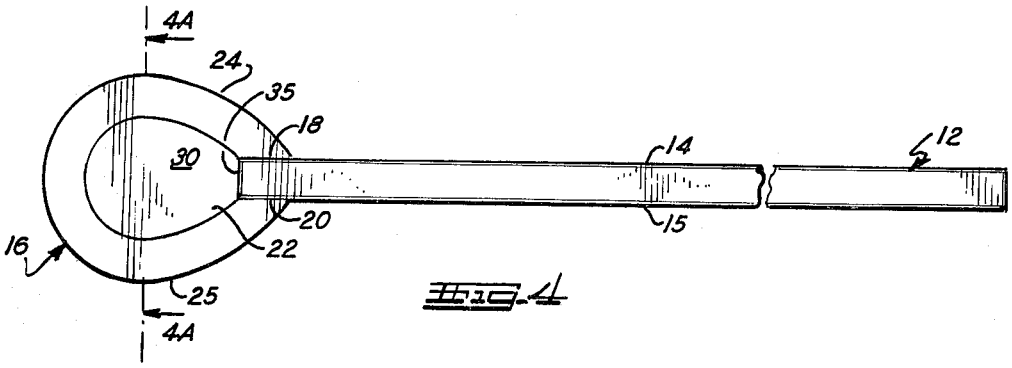
FIG. 4 is a side elevational view of a modification of the aquatic mat embodiment shown in FIG. 1.
Figure 4A:
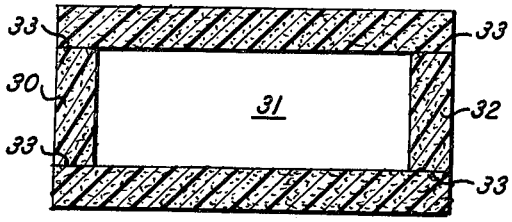
FIG. 4A is a section taken along line 4A—4A of FIG. 4.

In FIGS. 4 and 4A there is shown a modification of the aquatic mat of FIGS. 1—3. In the modification, generally ovate or round end members 30 and 32 formed from the coated slab material, are inserted and bonded in the end sections of the transverse void 22 of the headrest 16 forming an enclosed chamber 31 (not shown in FIG. 4). The bonding is shown at 33 between the inner end surfaces of the headrest and the edges of the end members 30 and 31. In addition, each end member 30 and 32 is bonded to the edge of slab 12 at 35 as shown with member 30 in FIG. 4. With the end members bonded in each end of the headrest, an airtight and leakproof chamber 31 is provided. The closing of the transverse void to form an enclosed chamber provides additional buoyancy to the headrest.

Figure 5:
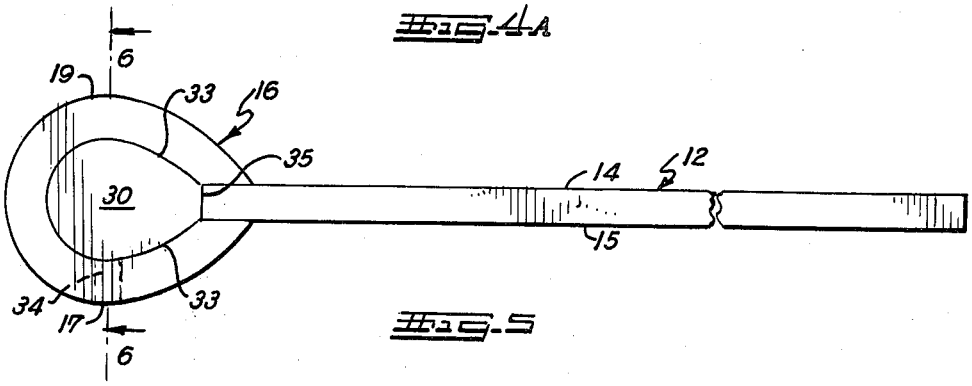
FIG. 5 is a side elevational view of a further modification of the aquatic mat embodiment shown in FIG. 4.
Figure 6:
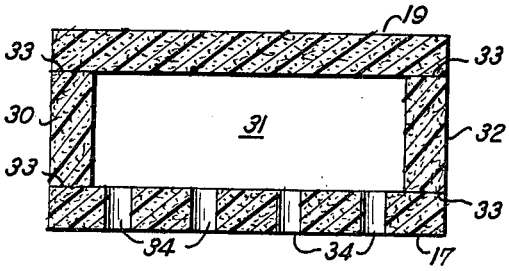
FIG. 6 is a section taken along line 6—6 of FIG. 5.

Referring now to FIGS. 5 and 6, there is shown a further modification of the mat containing an enclosed chamber as shown in FIG. 4. In this modification, the mat 10 is used with the surface 15 as the bottom and surface 14 as the top. The headrest 16 comprises a top portion 19 and bottom portion 17. A series of vent holes 34, up to about two inches in diameter, are disposed across and through the bottom portion 17 which communicates with the chamber 31. Holes 34 provide an equalization of pressures within the chamber 31 and ambient pressures, which change with temperature changes. Holes 31 provide additional buoyancy and structure to the headrest 16 when floating on water, i.e., the holes in contact with a water surface tend to retain air as an air pocket in chamber 31, and generally release the air from the chamber due to pressure on surface 19 from a person's head is prevented. It is understood that in the modification of mat 10 wherein an enclosed chamber is provided in the headrest of the mat, that the mat 10 can be used without the holes provided in the second modification. However, the modification provided with holes requires the use of a mat headrest with an enclosed chamber. Although, the modification of the enclosure of the headrest void with end members, and the further modification for provision of holes is shown with the mat embodiment 10, it is understood that these modifications are applicable to other embodiments of the mat to be described hereinafter.

Figure 7:
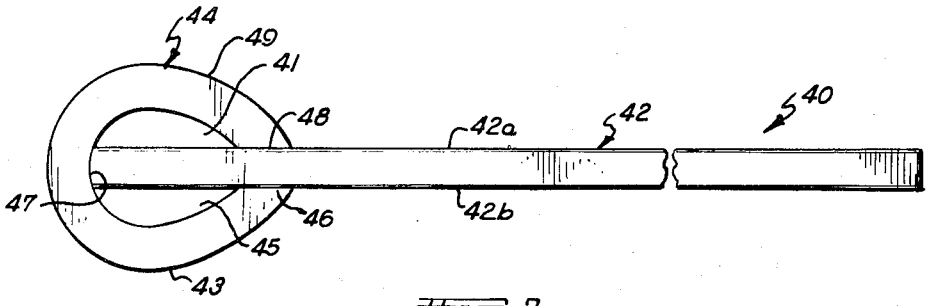
FIG. 7 is a side elevational view of a second embodiment of the aquatic mat of this invention.

In FIG. 7, a second embodiment 40 of the mat is shown, wherein a slab 42 has planar surfaces **42*a* and 42*b*. Headrest 44 has headrest surfaces 43 and 49. In this embodiment, the mat is constructed by bonding the slab 42 to the ends of the headrest at surfaces 46 and 48 and bonding the end of the slab 42 to inner surface 47 of the headrest, thus forming transverse voids 41 and 45. This embodiment provides additional structure to the headrest and can be used on either surface 42a or 42b**.

Figure 8:
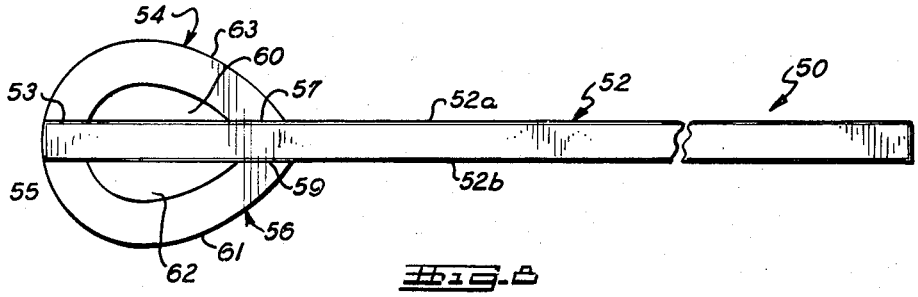
FIG. 8 is a side elevational view of a third embodiment of the aquatic mat of this invention.

In FIG. 8, a third embodiment 50 of the mat is shown, wherein a slab 52 has planar surfaces **52*a* and 52*b*. Headrests 54 and 56 are formed from separate slabs which are bonded to the respective ends of slab 52. Headrest 54 has headrest surface 63 and is bonded to surface 52*a* at 53 and 57 forming a void 60. Similarly, headrest 56 has surface 61 and is bonded to surface 52*b* at 55 and 59 forming a transverse void 62. The embodiment provides additional structure to the headrest area and can be used on either surface 52*a* or 52*b***.

Figure 9:
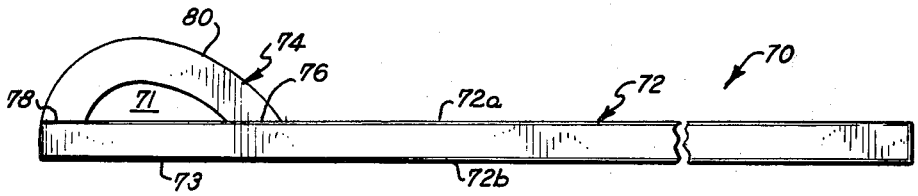
FIG. 9 is a side elevational view of a fourth embodiment of the aquatic mat of this invention.

In FIG. 9, a fourth embodiment 70 of the mat is shown, wherein a slab 72 has a top planar surface **72*a* and bottom planar surface 72*b*. A single headrest 74 has headrest surface 80 and the end of surface 72*a* and slab 72 is bonded to the headrest ends at 76 and 78 forming a transverse void 71**.

Figure 10:
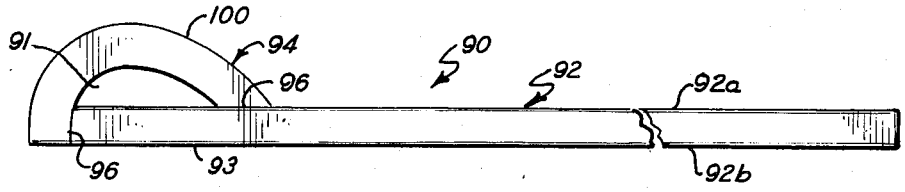
FIG. 10 is a side elevational view of a fifth embodiment of the aquatic mat of this invention.

In FIG. 10, a fifth embodiment 90 of the mat is shown, wherein a slab 92 has a top planar surface **92*a* and bottom planar surface 92*b*. A single headrest 94 has headrest surface 100 and the end of surface 92a of slab 92 is bonded to the headrest end area at 96 and the other end of the headrest is bonded to surface 92*a* at 96 forming a transverse void 91**.

It is understood that the concept of the first modification shown in FIGS. 4 and 4A with respect to the provision of a closed airtight chamber as used with embodiment 10, is also applicable with embodiments 40, 50, 70 and 90. Thus, in embodiment 40 of FIG. 7, end members can be bonded in both sides of transverse voids 41 and 45 to provide two airtight chambers; in embodiment 50 of FIG. 8, end members can be bonded in both sides of transverse voids 60 and 62 to provide two airtight chambers; in embodiment 70 of FIG. 9, end members can be bonded in both sides of transverse void 71 to provide a single airtight chamber; and in embodiment 90 of FIG. 10, end members can be bonded in both sides of transverse void 91 to provide a single airtight chamber.

Similarly, it is understood that the concept of the second modification shown in FIGS. 5 and 6, with respect to the provision of a series of vent holes as used with the embodiment 10 as modified with an airtight chamber in FIG. 4, is also applicable with embodiments 40, 50, 70 and 90. In each of these embodiments as modified with airtight chambers, a series of vent holes can be provided along the bottom of the headrest. Thus, in embodiment 40, the series of vent holes are disposed through headrest surface 43; and in embodiment 50, the vent holes are disposed through headrest surface 61. In embodiments 70 and 90, the vent holes are disposed through portion 73 of slab 72 and through portion 93 of slab 92, respectively. When the vent holes are provided, all the mat embodiments are used with the surface containing the vent holes on the surface of water From the above description of the aquatic floatable, mat of the invention, it is clear that a novel mat is provided for use in water sports, leisure, etc. The coating or casing 26 provides a surface which is smooth and protects the plastic foam 28 within. However, even if the coating 26 is damaged, ripped or torn, etc., the buoyancy of the mat is not diminished, because of the use of non-water absorbent closed-cell type plastic foam. Although, the mat has particular adaptability for use on water surfaces, it is understood that the mat can also be used on solid surfaces and also on uneven surfaces, such as sand beaches, to which the bottom of the mat will conform.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An aquatic floatation mat capable of floating in water and supporting one or more persons, comprising an elongated planar member having top and bottom planar surfaces and a headrest secured to and extending from an end portion of said planar member; said planar member and said headrest formed from closed cell, unicellular, plastic foam slab members, which are flexible, resilient and non-water absorbent, and which have a surface coating of a tough, pliable, plastic material; said headrest slab member having ends thereof secured to an end portion of said planar member, said headrest has a generally rounded shape and includes one open transverse void above said top planar surface.

2. The aquatic mat of claim 1 wherein said headrest slab member is curved around an end portion of said planar member, the ends of said headrest are secured to the top and bottom planar surfaces at an intermediate portion near the said end portion of said planar member, and the end edge of said planar member is secured to an inner surface of said surved headrest slab member thereby forming two transverse voids, wherein one void is above said top planar surface and one void is below said bottom planar surface of said planar member.

3. The aquatic mat of claim 1 wherein said headrest comprises a curved slab member on each said top and bottom planar surface at said end portion of said planar member, one end of each said respective slab member secured to the said end portion of said respective planar surface and the other end of each said respective slab member secured to an intermediate portion of said respective planar surface near said end portion thereby forming two transverse voids, wherein one void is above and one void is below said planar member.

4. The aquatic mat of claim 1 wherein said headrest comprises one curved slab member on said top planar surface of said planar member, one end of said slab member secured to the end portion of said top planar surface and the other end secured to an intermediate portion of said top planar surface near said end portion thereby forming one transverse void above said top planar surface.

5. The aquatic mat of claim 4 wherein said headrest comprises end members enclosing said transverse void to form an air chamber, and vent holes disposed through said planar member communicating with said air chamber.

6. The aquatic mat of claim 1 wherein said headrest comprises one curved slab member on said top planar surface of said planar member, one end of said slab member secured to the end edge of said planar member and the other end secured to an intermediate portion of said top planar surface near said end portion thereby forming one transverse void above said top planar surface.

7. The aquatic mat of claim 1 wherein said plastic foam is produced from polyvinylchloride.

8. The aquatic mat of claim 1 wherein said plastic coating material is firmly adherent to said plastic foam.

9. The aquatic mat of claim 1 wherein said plastic coating is a sprayed coating.

10. The aquatic mat of claim 1 wherein said plastic coating is a dipped coating.

11. The aquatic mat of claim 1 wherein said headrest comprises end members enclosing said transverse voids to form an air chamber.

12. The aquatic mat of claim 11 wherein said headrest has an enclosed transverse void disposed below the bottom planar surface comprising vent holes in the bottom portion of said headrest communicating with said enclosed air chamber.

* * * * *